United States Patent [19]

Benoy et al.

[11] 4,339,092

[45] Jul. 13, 1982

[54] ROTARY CUTTER FOR SHEET OR STRIP MATERIAL AND ITS USE IN A BELT WRAPPER

[75] Inventors: David C. Benoy, Swanage; George T. F. Kilmister, Christchurch, both of England

[73] Assignee: Loewy Robertson Engineering Co. Ltd., Poole, England

[21] Appl. No.: 94,211

[22] Filed: Nov. 19, 1979

[30] Foreign Application Priority Data

Nov. 21, 1978 [GB] United Kingdom ..... 45385/78
Nov. 21, 1978 [GB] United Kingdom ..... 45386/78

[51] Int. Cl.[3] ..... B65H 19/20

[52] U.S. Cl. ..... 242/56 R; 83/169; 83/337; 83/152

[58] Field of Search ..... 242/56 R, 56 A, 56.6, 242/78.1, 78.3; 83/169, 177, 337, 402, 152

[56] References Cited

U.S. PATENT DOCUMENTS

| | | | |
|---|---|---|---|
| 3,057,239 | 10/1962 | Teplitz | 83/337 |
| 3,174,372 | 3/1965 | Huck | 83/152 X |
| 3,490,711 | 1/1970 | Cambon | 242/56 R |
| 3,549,097 | 12/1970 | Seigh | 242/56 A |
| 3,552,670 | 1/1971 | Herman | 242/56 A |
| 3,640,480 | 2/1972 | Schleich | 242/56 R |
| 3,869,095 | 3/1975 | Diltz | 242/56 R |
| 3,910,518 | 10/1975 | Yamaguchi | 242/56 A |
| 3,943,686 | 3/1976 | Crawford et al. | 83/337 X |

*Primary Examiner*—John M. Jillions
*Attorney, Agent, or Firm*—Schwartz & Weinrieb

[57] ABSTRACT

A rotary cutter for sheet or strip material, comprises a roller with an air-pervious surface to which negative air pressure can be applied and an axially disposed knife in the roller which intermittently projects radially from the roller to cut the material when held thereon by negative pressure. Such a cutter can conveniently form part of a belt wrapper for starting a coil of material, where unwanted material can be cut and discarded.

9 Claims, 6 Drawing Figures

ROTARY CUTTER FOR SHEET OR STRIP MATERIAL AND ITS USE IN A BELT WRAPPER

FIELD OF THE INVENTION

This invention relates to rotary cutters for sheet or strip material such as paper or metal foil, and belt wrappers incorporating such cutters employed to start a coil of such material issuing from a sheet or strip processing plant.

BACKGROUND OF THE INVENTION

Industrial process lines which handle sheet or strip material often need to be provided with means for cutting the sheet or strip. When using conventional guillotine or sawing techniques, the line must be halted for the cutting operation. It is, however, desirable to avoid halting the process line and to provide cutting means which are compatible with the movement of the sheet or strip to give a cut of acceptable quality without damage to the cutting means.

An example is in the starting of a coil of sheet or strip material, when the leading length of the material is frequently below the desired product standard for the coiled material. Thus, for example, for strip material issuing from a coating plant, the leading end of the strip may not be evenly coated, while for strip issuing from a laminating plant, the leading end may be a sub-standard laminate resulting from difference in feeding speeds and operating speeds. Yet again, in a metal rolling process, absence of tension on the strip at the leading end may result in an unacceptable shape in the initial lengths of strip. Any one of such poorly shaped materials, if used as the basis of a coil, generates an imperfect cylinder on the spool on which the coil is to be formed and can thus not only affect the accuracy of coiling in the early laps but can even destroy the quality of the finished material by the carrying through of imperfections of the leading lengths of the material right through the coil. It is at present common practice to cut off the early lengths of the material and strip the mis-shaped material from the spool in a manual operation before the use of a belt wrapper to introduce material to the spool.

OBJECTS OF THE INVENTION

It is an object of the invention to provide an improved cutter for sheet or strip material.

It is a further object of the invention to provide an improved belt wrapper employing such a cutter.

These and other objects of the invention will appear from the following description and claims.

SUMMARY OF THE INVENTION

According to one aspect of the present invention, we provide a rotary cutter for sheet or strip material comprising a roller, having an air-pervious surface, means to apply negative air pressure to at least a portion of the air-pervious surface, at least one longitudinally disposed knife mounted in the roller and means to intermittently cause the knife to project radially from the roller and cut sheet material held over the adjacent portion of the roller by negative air pressure.

The knife cutting edge may be plain or serrated. The knife may be mounted via a slide casing in the roller, the knife having at least one cam slot engaged by a projection from the casing and actuating means being provided to intermittently move the knife relative to the projection axially and radially from a retracted position to a position in which the knife projects radially of the roller. The actuating means may conveniently be a cam mounted on the stator of the roller which can be positioned when desired to contact a cam follower on the knife. The knife is normally held in its retracted position, for example by spring means.

The roller conveniently has a perforated outer surface and the interior of the roller is divided into segments communicating with inlet and outlet means for the supply or evacuation of air from the segments, so as to create zones of positive or negative pressure at portions of the outer surface.

According to a further aspect of the invention we provide a belt wrapper, for starting a coil of sheet or strip material issuing from a sheet or strip processing plant, comprising a belt arranged to contact a portion of the periphery of a spool about which the strip material is to be wound and move in a direction which draws the leading portion of the strip around the spool, and a rotary cutter as described above arranged to lie adjacent the periphery of the spool outside the portion contacted by the belt, the roller of the rotary cutter having means to apply negative or positive pressure to that portion of the air-previous surface adjacent the spool periphery, so that, in use, while negative pressure is applied, the material is discarded from the spool and, when positive pressure is applied, the material follows the periphery of the spool to form a coil.

Preferably, the belt wrapper is arranged so that it can be withdrawn from contact with the spool after the formation of the coil has been satisfactorily initiated. Preferably the rotary cutter co-operates with means for withdrawing discarded material to a waste disposal device.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts of the invention throughout the several views, and wherein.

DESCRIPTION OF THE PREFERRED EMBODIMENTS

Figure 1:
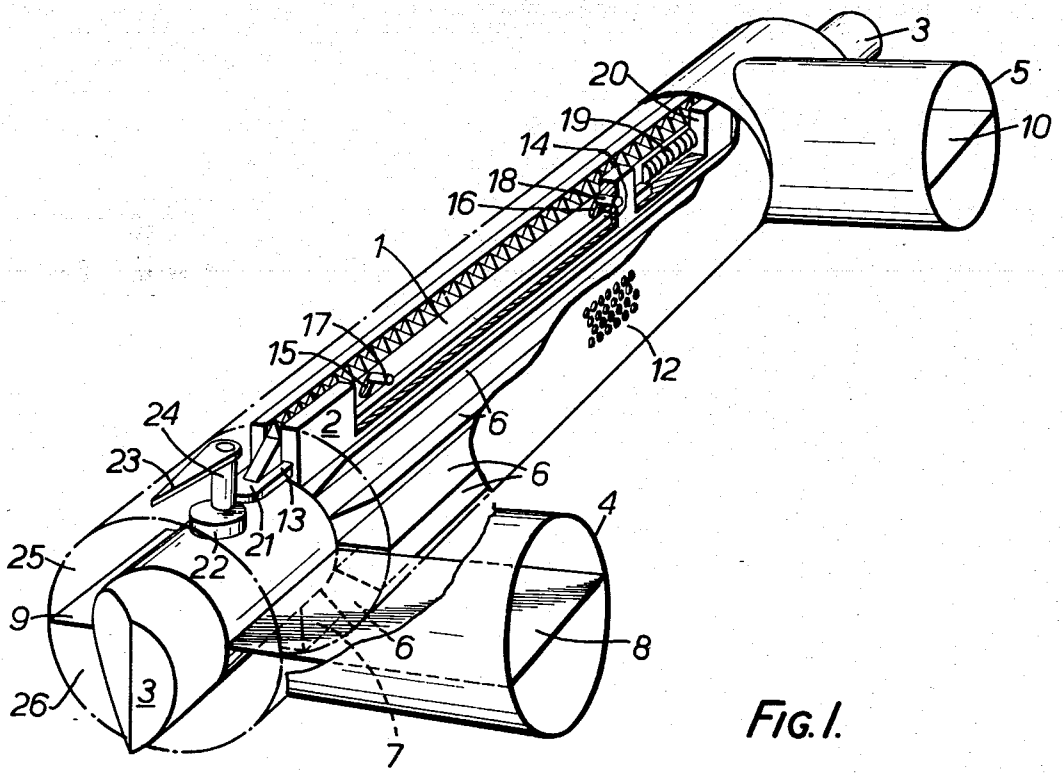
FIG. 1 is a perspective sketch, partly in section of a rotary cutter according to the invention.

With reference to FIG. 1, the cutter comprises a serrated knife blade 1 mounted in a slide casing 2. Casing 2 is attached to a rotor shaft 3 so that the knife is axially disposed with respect to shaft 3. Rotor shaft 3 is mounted on bearings (not shown) housed within stator chambers 4 and 5. Shaft 3 is provided with a number of radially directed vanes 6 extending axially of the shaft 3. The outer edges of vanes 6 and the casing 2 are encased in a perforated metal skin forming a roller 12. Thus flow of air is permitted to and from the ambient atmosphere through the roller 12 from and to the segment chambers formed by vanes 6 within the roller 12. A mass balance 7 is also provided on shaft 3.

Means (not shown) are provided for the supply or withdrawal of air from stator chambers 4 and 5. For this purpose chamber 4 is divided into two sections by splitter plates 8 and 9, while chamber 5 is divided by similar splitter plates, only one of which, 10, is shown.

Knife blade 1, when not being employed for cutting, is mounted so that its teeth do not project from the surface of roller 12. The knife blade has a T-section, the cross-bar of the T being mounted to slide in a T-slot 13 provided in the base of casing 2. A radial clearance 14 is provided between the blade 1 and casing 2 so that the knife blade can be moved radially to project from the roller surface. Blade 1 is provided with two or more cam slots 15 and 16, which are engaged by pins 17 and 18 respectively projecting internally from slide casing 2. Blade 1 is biassed towards its retracted position by means of a compression spring 19 positioned in a cut away portion of blade 1 against a stop 20 on casing 2. Thus the knife can move axially and radially against the action of spring 19, so as to project from the surface of roller 12.

Knife 1 is actuated by the provision of a cam follower 21 on one end thereof. Cam follower 21 can be engaged, when it is desired to move the blade 1 to its cutting position, by adjusting the position of cam 22 mounted on stator chamber 4. For this purpose cam 22 is provided with a shaft 24 attached to operating lever 23. Thus rotation of the cam 22 through, for example 180°, will cause the cam 22 to contact cam follower 21 during each rotation of roller 12 thus actuating the knife 1 against the spring 19 for each turn of the roller.

Figure 2A:
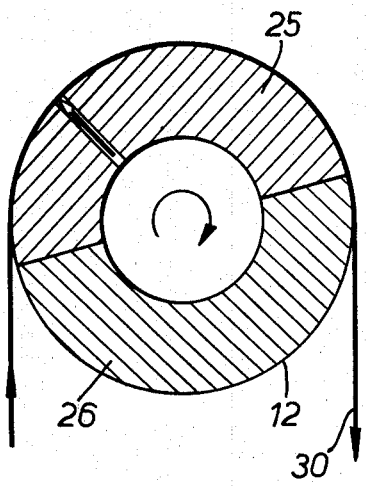
FIGS. 2A, 2B and 2C are cross sectional diagrams through the cutter illustrating its function.
Figure 2B:
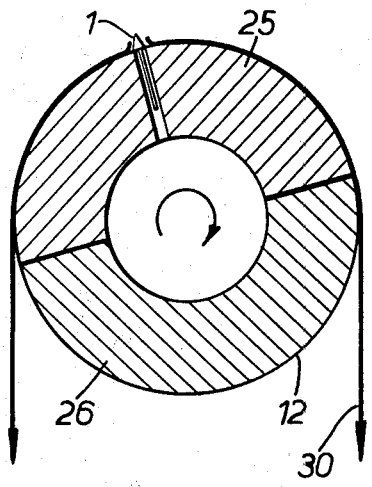
Figure 2C:
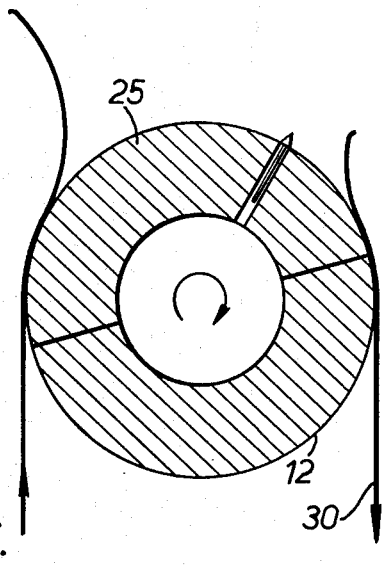

In use, sheet or strip material to be cut is held against the surface of roller 12 as illustrated in FIGS. 2A, 2B and 2C. Thus, as shown in FIG. 2A, material 30 is passed around roller 12 with knife blade 1 retracted in the roller. Material 30 is held against the roller 12 by application of negative pressure to segment 25 by withdrawal of air through the appropriate sub-chambers of stator chambers 4 and 5. Segment 25, by means of splitter plates 8, 9 and 10 and vanes 6 is aerodynamically isolated from segment 26 of the roller 12. Segment 26 may be supplied with positive pressure via the stator chambers 4 and 5, so that material 30 does not lap completely around the roller 12. In this position, the knife 1 can be actuated by lever 23 to cut the material while it is held against the segment 25 by negative pressure, as shown in FIG. 2B. After cutting, if it is desired to separate off the cut strip, by actuating suitable valve means the segment 25 can be supplied with positive pressure so that the cut strip of material 30*a*, is pushed away from the roller 12, for example to suitable waste disposal means, while the main strip of material 30 is also fed away from the roller 12, for example to the nip of a belt wrapper for winding on a spool.

The knife described above is particularly suitable for use, for example, in the disposal of scrap foil or paper using a belt wrapper, where it is desired to coil only good quality material. It is particularly useful for cutting thin materials, for example of approximately 1 mm or less, for example metal foils such as aluminium, which often have an upper thickness limit of as little as 0.15 mm.

However, the rotary cutter can obviously be used for other purposes and many modifications are possible. Thus the stator chambers 4 and 5 may be divided into more than two sub-chambers, while more than one knife blade 1 may be mounted in the roller; for example, so as to cut off predetermined lengths of sheet related to the roller circumference.

It can be seen from the foregoing description that the rotary cutter of the invention can be used for cutting sheets or strips, especially thin sheet while the sheet is in motion in a continuous process, without the need to stop the line for the cutting operation. As the cutter is rotary in design, it occupies minimal space and is thus suitable for positioning in processes where space limitations would preclude the use of conventional cutting such as flying shears.

Figure 3:
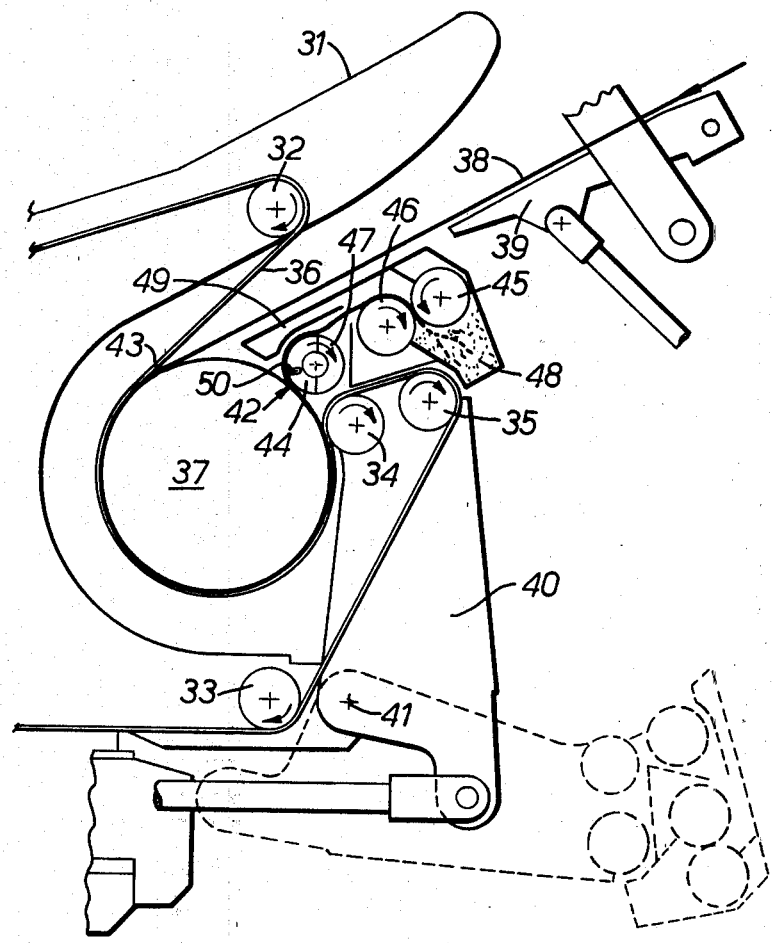
FIG. 3 is a diagrammatic representation of a belt wrapper of the invention in use while unsatisfactory material is being discarded.
Figure 4:
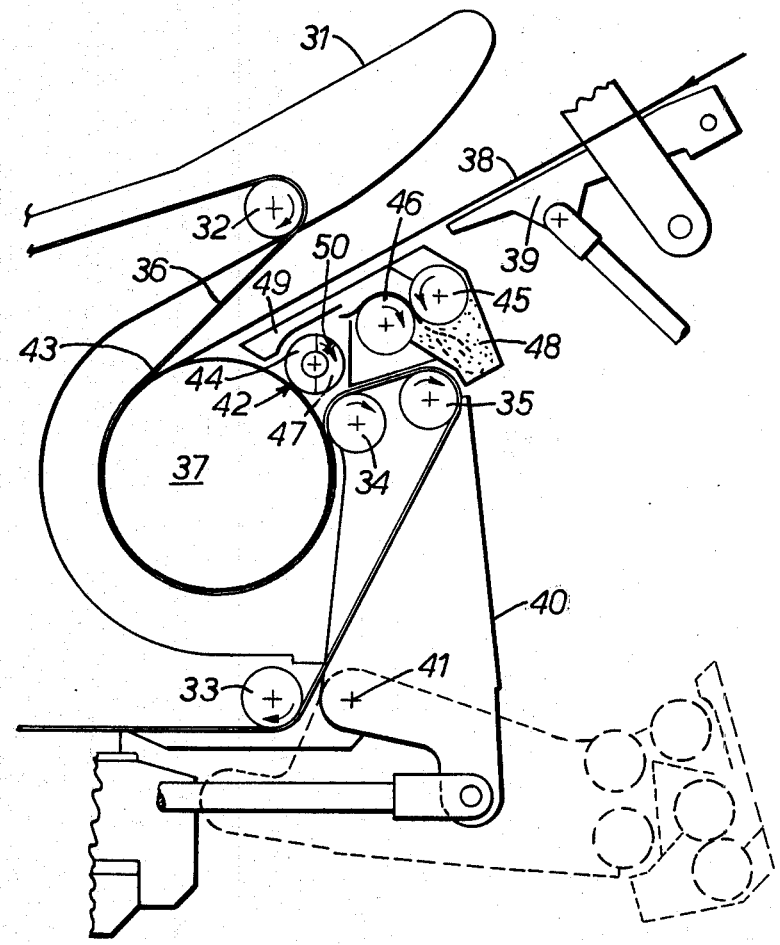
FIG. 4 is a diagrammatic representation of the belt wrapper after discarded material has been cut away and satisfactory material is being coiled.

One example of the use of the rotary cutter is in a belt wrapper as shown in FIGS. 3 and 4.

As shown in FIGS. 3 and 4, the belt wrapper comprises a casing 31 provided with a series of rollers 32, 33, 34 and 35 guiding a belt 36 which is endless and moves in the direction shown by the arrow on the rollers 32, 33, 34 and 35 so as to pass around a substantial portion of the periphery of a spool 37. Strip material 38 is passed from a carry-over table 39 from a strip processing plant, such as a rolling mill, and led around the periphery of spool 37. Rollers 34 and 35 of the belt wrapper are mounted on a swinging arm 40, which, when the belt wrapper is not in use and the coil has been satisfactorily started, can be swung away about pivot point 41 to the position shown in dotted lines.

The swinging arm 40 is also provided with a roller 42 in the form of a rotary cutter as previously described and which is situated adjacent the periphery of the spool 37 but downstream (in the direction of movement of the belt) of the last contact point of the belt 36 with the spool 37. The roller 42 is thus outside the belt circuit and its function is to remove, from the spool, material which is unsatisfactory for forming part of the coil. Such material is thus prevented from entering the belt wrapper bite 43. Roller 42 has a perforated outer surface so as to permit passage of air between the interior of the roller and the outside atmosphere. Positive or negative pressure can be applied to that segment (of fixed orientation relative to earth) adjacent the surface of spool 37. In FIG. 3, the segment 44 has negative pressure applied thereto, so that the portion of material 38 adjacent the roller 42 is carried over the roller 42 away from spool 37. The material is led to the nip between rollers 45 and 46, which may conveniently be provided with knives to form a scrap removal and comminuting device. To assist in this movement of material to the scrap removal device, a further segment 47 of the roller 42 is provided with positive pressure, while the region downstream of the rollers 45 and 46, designated 48, is provided with negative pressure. Furthermore, positive pressure may be applied to that portion 49 of the arm 40 immediately above the roller 42 so that the material 38 is positively drawn around roller 42 and into the scrap removal device for comminution.

When material of satisfactory quality begins to be wound around spool 37 by means of belt 36, a knife 50, set in roller 42 is actuated to cut through the material adjacent roller 42. Then suitable operating valve means are actuated to supply positive air pressure to segment 44 of roller 42, and to return the air pressure in segment 47 and in portion 49 to normal. Thus as shown in FIG. 2, the leading end of the material 38 is free to pass around the remainder of the periphery of the spool 37 and into the belt wrapper bite 43 to initiate a coil. The tail end of the cut-off material withdrawn around roller 42 continues to pass into the waste disposal device for comminution.

It can be seen from the foregoing description that the belt wrapper provides an automated means of ensuring that only good quality material is wound on the spool, and as the roller 42 also exerts tension on the material through the application of negative pressure via a segment 44, it assists in the aligning of poorly shaped material to produce correctly shaped material. Thus, for example, if the invention is applied to foil mills, one can obtain a significant reduction in the start-up coiling time and the volume of scrap produced, at the same time reducing the number of manual operations to be performed in the process. Obviously, many modifications and variations of the present invention as possible in light of the above teachings. It is therefore to be understood that within the scope of the appended claims, the present invention may be practiced otherwise than as specifically described herein.

We claim:

1. A rotary cutter for sheet or strip material comprising:

a roller, having an air-pervious shell;

means to apply negative air pressure to at least a portion of the interior surface of the air-pervious shell from within said roller for attracting said sheet or strip material into contact with the exterior surface of said portion of said roller shell;

at least one longitudinally disposed knife mounted within said roller so as to be normally disposed in a retracted position radially inwardly of said roller shell; and means to intermittently cause the knife to project radially outwardly beyond said outer surface of said roller shell from said normal disposition within said roller shell for cutting said sheet or strip material when said sheet or strip material is held in contact over said exterior surface of said portion of the roller by said negative air pressure, said intermittent means comprising a cam follower disposed upon said knife, stator means disposed adjacent to said roller, and a cam fixedly mounted upon said stator means during a camming operation for contacting said cam follower disposed upon said knife.

2. The rotary cutter as set forth in claim 1 wherein: said cam follower is integral with said knife.

3. The rotary cutter of claim 1, comprising:

at least one cam slot in the knife;

at least one projection in the roller engaging the cam slot or slots;

means to move the knife relative to the projection or projections axially and radially from a retracted position to a position in which the knife projects radially of the roller.

4. The rotary cutter of claim 1, wherein the knife is normally biased towards a retracted position.

5. The rotary cutter of claim 1, wherein the knife has a serrated cutting edge.

6. The rotary cutter of claim 1, wherein the roller has a perforated outer surface and the interior of the roller is divided into segments communicating with inlet and outlet means for the supply or evacuation of air from the segments.

7. A belt wrapper for starting a coil of sheet or strip material issuing from a sheet or strip processing plant, comprising:

a spool arranged to contact a portion of the periphery of said spool about which the strip material is to be wound, and moved in a direction which draws the leading portion of the strip around the spool; and a rotary cutter arranged to lie adjacent the periphery of the spool outside the portion contacted by the belt, the rotary cutter comprising:

a roller, having an air-pervious surface;

means alternatively apply negative and positive air pressure to that portion of the air-pervious surface adjacent the spool periphery;

at least one longitudinally disposed knife mounted in the roller; and means to intermittently cause the knife to project radially from the roller and cut said material when held over the adjacent portion of the roller by negative air pressure;

whereby when negative pressure is applied the material is cut by the knife and discarded from the spool and, when positive pressure is applied, the material follows the periphery of the spool to form a coil.

8. The belt wrapper of claim 7, further comprising:

a waste disposal device positioned downstream of the rotary cutter.

9. The belt wrapper of claim 7, further comprising:

means for withdrawal of the belt wrapper from contact with the spool after formation of the coil has been satisfactorily initiated.

* * * * *